US006236825B1

(12) United States Patent
Takeuchi

(10) Patent No.: US 6,236,825 B1
(45) Date of Patent: May 22, 2001

(54) IMAGE FORMING APPARATUS INCLUDING LIQUID-TYPE DEVELOPING DEVICE

(75) Inventor: Noriyasu Takeuchi, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/448,296

(22) Filed: Nov. 24, 1999

(30) Foreign Application Priority Data

Nov. 26, 1998 (JP) ..... 10-335558

(51) Int. Cl.[7] ..... G03G 15/10
(52) U.S. Cl. ..... 399/237; 399/238
(58) Field of Search ..... 399/237, 238, 399/239, 233; 430/117–119; 222/DIG. 1

(56) References Cited

U.S. PATENT DOCUMENTS

| | | | | |
|---|---|---|---|---|
| 3,687,109 | * | 8/1972 | Eqnaczak | 118/637 |
| 5,436,706 | * | 7/1995 | Landa et al. | 355/256 |
| 5,689,779 | * | 11/1997 | Miyamoto | 399/237 |
| 5,708,938 | | 1/1998 | Takeuchi et al. . | |
| 5,918,093 | * | 6/1999 | Kim | 399/237 |
| 5,933,689 | * | 8/1999 | Kim | 399/233 |
| 5,937,247 | | 8/1999 | Takeuchi et al. . | |
| 5,937,248 | * | 8/1999 | Liu et al. | 399/237 |
| 5,950,054 | * | 9/1999 | Kim | 399/237 |
| 5,999,778 | * | 12/1999 | Chang et al. | 399/237 |
| 6,020,099 | * | 2/2000 | Liu et al. | 430/97 |

FOREIGN PATENT DOCUMENTS

| | | |
|---|---|---|
| 07152254 | 6/1995 | (JP) . |
| 07209922 | 8/1995 | (JP) . |
| 07219355 | 8/1995 | (JP) . |
| 08328392 | 12/1996 | (JP) . |

* cited by examiner

*Primary Examiner*—Richard Moses
(74) *Attorney, Agent, or Firm*—Oblon, Spivak, McClelland, Maier & Neustadt, P.C.

(57) ABSTRACT

An image forming apparatus to develop a latent image formed on an image bearing member with a liquid type developer. In the image forming apparatus, a developer container contains the liquid-type developer. A developer carrier carries the liquid-type developer to supply the liquid-type developer to the image bearing member. A developer applying device applies the liquid-type developer to the developer carrier. A holding part holds a part of the liquid-type developer contained in the developer carrier and is located below the developer applying device. A developer transfer device transfers the liquid-type developer from the developer container to the holding part. As a further feature, the developer transfer device may include a developer transfer member having a width smaller than a length of the developer applying roller in an axial direction and a developer spread device provided between an outlet of the developer transfer member and an inlet of the holding part. The developer spread device spreads the liquid-type developer in the axial direction of the developer applying roller. In the image forming apparatus, the liquid-type developer can be efficiently spread out on the developer carrier, and can thereby be effectively applied from the developer carrier on the image bearing member to develop the latent image.

20 Claims, 6 Drawing Sheets

IMAGE FORMING APPARATUS INCLUDING LIQUID-TYPE DEVELOPING DEVICE

BACKGROUND OF THE INVENTION

1. Field of the Invention

The present invention relates to an image forming apparatus such as a copying machine, a printer, a facsimile machine, or the like, and more particularly to a developing device for developing a latent image formed on an image bearing member with a liquid type developer having high viscosity.

2. Discussion of the Background

A background developing device used in a background image forming apparatus, which develops a latent image formed on an image bearing member with liquid type developer (hereinafter referred to as developing liquid) having high viscosity, is described in Japanese Laid-open Patent Publication Nos. 07-152254, 07-209922, and 07-219355, for example. In the above-described background image forming apparatus, a photoconductive surface of an image bearing member is uniformly charged by a charge-applying device and is then exposed by an image writing device based on image data. Thereby, a latent image is formed on the image bearing member. A liquid-type developing device then develops the latent image. The developing liquid used in the liquid-type developing device includes a carrier liquid composed of dimethyl siloxane oil, for example, having a viscosity as high as 100 mPa·s to 10,000 mPa·s, an insulating character, and toner particles dispersed therein at a high ratio. A container, such as a tank, stores the developing liquid in the liquid-type developing device.

The developing liquid is applied to a surface of a developing roller or a surface of a developing sleeve in the liquid-type developing device to form a thin layer of uniform thickness. The latent image is developed when the developer layer passes through a developing station and the toner therein spreads to the latent image area formed on a photoconductive element, thereby forming a visible toner image thereon. The developing liquid remaining on the surface of the developing roller is removed by a blade and is then collected in the tank. The toner image is then transferred from the photoconductive element to a copy sheet by a transfer device and is then fixed on the copy sheet by a fixing device. The developer remaining on the surface of the photoconductive element after the image transfer is removed by a cleaning device.

In the above-described liquid-type developing device, a developer applying device forms the developer layer on the surface of the developing roller by applying developing liquid thereto by supplying the developing liquid to the developing roller. As the developer applying device, a developer applying roller is generally used, as configured in an ink applying system for a duplicating machine. In order to form a thin layer of uniform thickness on a developer carrier such as a developing roller and a developing sleeve, a sufficient volume of developing liquid needs to be supplied to the developer applying device. As alternative developer applying devices, an applying belt, a hollow cylindroid applying sleeve, or the like, can be employed.

As a method of supplying developing liquid to the developer applying device, such as the developer applying roller, developing liquid may be pumped up by a pump and applied to the developer applying roller. In this method, the pump serves as a developer transfer device and the developing liquid can be supplied to the developer applying roller irrespective of a volume of the developing liquid in the tank.

However, in the case of using the pump, the developing liquid typically does not evenly spread over the surface of the developer applying roller in the axial direction thereof due to its high viscosity. In addition, because a contact area in the circumferential direction of the developer applying roller between the developer applying roller and the developing liquid discharged from an outlet of the pump is typically small, the developing liquid is not sufficiently supplied to the surface of the developer applying roller. In order to supply the developing liquid sufficiently to the developer applying roller, a plurality of outlets of pumps need to be disposed over the surface of the developer applying roller in the axial direction thereof. In this case, a size of the developing device becomes big and its cost increases.

On the other hand, as another method of supplying developing liquid to the developer applying roller, the developer applying roller may be directly immersed in the developing liquid in the tank. In this method, the developing liquid is supplied to the developer applying roller evenly, and a size of the developing device can be small because the mechanism is simple.

However, the following problems arise in the method of immersing the developer applying roller in the developing liquid. When the surface of the developing liquid falls below the lowermost part of the developer applying roller in the tank, the development operation cannot be continued even though some developing liquid remains in the tank, because the developer applying roller does not contact the remaining developing liquid. To ensure that the lowermost part of the developing roller is always immersed in the developing liquid, the storage space of the tank needs to be expanded in the horizontal direction, again resulting in increased size and costs.

When a latent image is developed with the developing liquid of high viscosity, the following problem arises as a result of utilizing the developing liquid of high viscosity. Generally, when developing a latent image, toner in a carrier liquid moves from a developer carrier (e.g., a developing roller) to a latent image on an image bearing member (e.g., a photoconductive element) at a developing station where the developer carrier contacts the image bearing member. When the carrier liquid has high viscosity, the moving speed of toner becomes slower in comparison with a carrier liquid without high viscosity. Accordingly, the developing process needs to proceed slowly. As one solution to solve this problem, a developer carrier having flexibility can be employed to make the nip portion between the developer carrier and the image bearing member wider at the developing station.

Another problem arises as a result of using developing liquid of high viscosity. As illustrated in FIG. 8, when the developing liquid 4 of high viscosity is applied to a developer carrier via a developer applying roller 14, a hanging back phenomenon occurs in which a gap G is produced between a surface of the developing liquid 4 and a surface of the developer applying roller 14 upstream from the bottom part of the developer applying roller 14 in the rotating direction. Specifically, when the developer applying roller 14 rotates in the direction indicated by arrow E in FIG. 8, the developing liquid 4 moves together with the developer applying roller 14 in the same direction as the arrow E. After the developing liquid 4 moves, the gap G is produced because the developing liquid 4 is viscous and its moving speed is slow; that is, the gap G is not filled with the developing liquid 4 quickly. Due to the above-described hanging back phenomenon, the contact time between the developer applying roller 14 and the developing liquid 4 is caused to be short, and as a result the developing liquid 4 cannot be supplied to the developer applying roller 14 sufficiently.

SUMMARY OF THE INVENTION

The present invention has been made in view of the above-discussed and other problems, and an object of the present invention is to provide a novel image forming apparatus that form good quality images by uniformly applying a liquid type developer having high viscosity to a developer carrier.

In order to achieve the above-noted and other objectives, the present invention provides a novel image forming apparatus to develop a latent image formed on an image bearing member with a liquid-type developer. In the novel image forming apparatus of the present invention, a developer container contains the liquid-type developer. A developer carrier carries the liquid-type developer to supply the liquid-type developer to the image bearing member. A developer applying device applies the liquid-type developer to the developer carrier. A holding part holds a part of the liquid-type developer contained in the developer carrier and is located below the developer applying device. A developer transfer device transfers the liquid-type developer from the developer container to the holding part.

As a further feature in the present invention, the developer transfer device may include a developer transfer member having a width smaller than a length of the developer applying roller in an axial direction and a developer spread device provided between an outlet of the developer transfer member and an inlet of the holding part. The developer spread device spreads the liquid-type developer in the axial direction of the developer applying roller.

By utilizing a novel image forming apparatus such as in the present invention, the liquid-type developer can be efficiently spread out on the developer carrier, and can thereby be effectively applied from the developer carrier on the image bearing member to develop the latent image.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
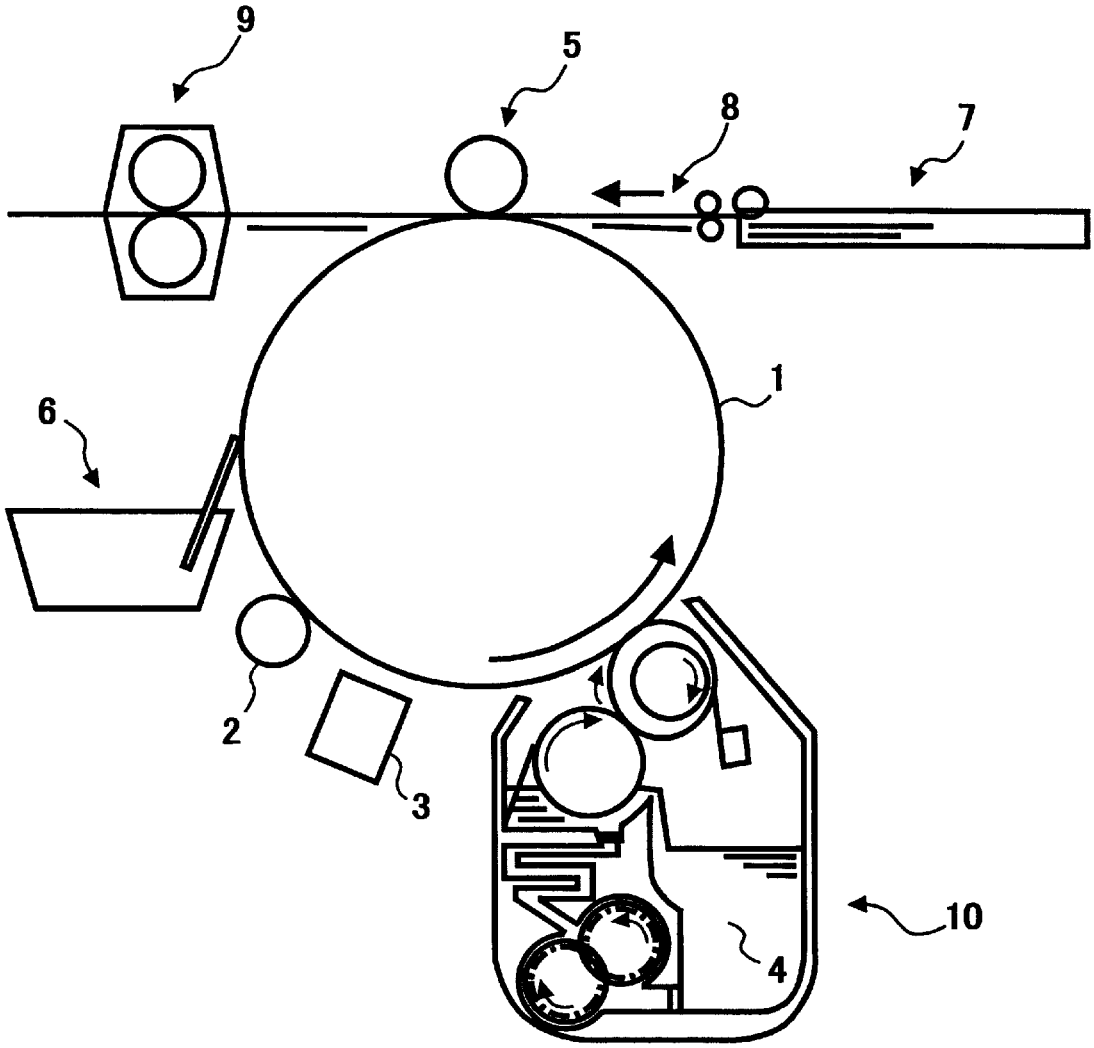
FIG. 1 is a schematic view illustrating an overall configuration of an image forming apparatus according to a first embodiment of the present invention.

Referring now to the drawings, wherein like reference numerals designate identical or corresponding parts throughout the several views, embodiments of the present invention applied to an image forming apparatus, e.g. a copying machine, using an electrophotographic method are now described.

FIG. 1 is a schematic view illustrating an overall configuration of an image forming apparatus according to a first embodiment of the present invention. In the image forming apparatus, which in this example is a copying machine, a photoconductive drum 1 serving as an image bearing member is provided. Arranged around the photoconductive drum 1 are a discharging roller 2, an exposure device 3 serving as an image writing device, a liquid-type developing device 10 (hereinafter simply referred to as the developing device 10), a transfer device 5, and a cleaning device 6. A transfer sheet 8 is fed from a sheet feeding unit 7 and is transferred through a sheet conveying path to the transfer device 5, which transfers toner images to the transfer sheet 8, and is then transferred to a fixing device 9 in which toner images are fixed to the transfer sheet 8.

After the charging roller 2 charges the photoconductive drum 1, the exposure device 3 exposes the charged surface of the photoconductive drum 1 with light corresponding to an image to form a latent image. The latent image is developed and made visible with developing liquid 4 stored in the developing device 10. The developing liquid 4 used in the embodiments of the present invention includes, as an example, a carrier liquid composed of dimethyl siloxane oil, for example, having a viscosity as high as 100 mPa·s to 10,000 mPa·s, an insulating character, and toner particles dispersed therein at a high ratio. A toner image developed with the developing liquid 4 on the photoconductive drum 1 is transferred by the transfer device 5 to the transfer sheet 8 fed from the sheet feeding unit 7. The toner image transferred to the transfer sheet 8 is conveyed to the fixing device 9 and is fixed on the transfer sheet 8 under the influence of heat and pressure. The cleaning device 6 removes residual developing liquid from the photoconductive drum 1, and thereby the above-described image forming cycle is completed and can then be repeated.

Figure 2:
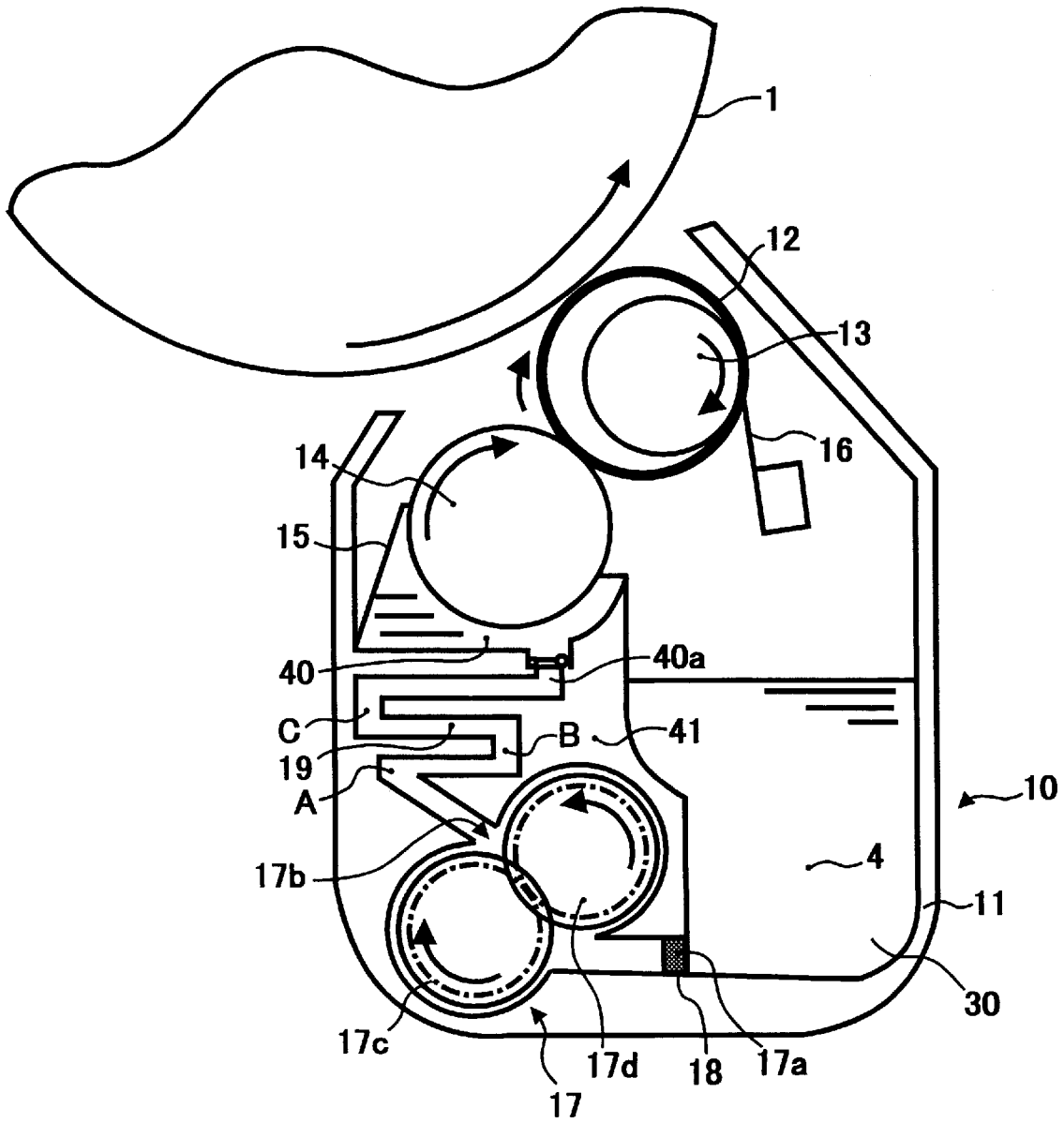
FIG. 2 is an enlarged schematic view of a liquid-type developing device according to the first embodiment of the present invention.

Next, a configuration of the developing device 10 of the above-described image forming apparatus is described. Referring to FIG. 2, the developing device 10 includes a tank 11 to store the developing liquid 4. In the tank 11, there are provided a developing sleeve 12 as a developer carrier, a driving roller 13 which drives the developing sleeve 12, a developer applying roller 14 serving as a developer applying device, a doctor blade 15 which regulates the thickness of the developing liquid 4 on the developer applying roller 14, and a collecting blade 16 which collects residual developing liquid 4 from the developing sleeve 12.

The tank 11 includes a containing part 30 that contains the developing liquid 4, and a holding part 40 that holds a part of the developing liquid 4. The holding part 40 is formed at an upper part of a holding part forming section 41 that is integrally formed with the tank 11 such that the holding part 40 occupies a part of the tank 11. In addition, the holding part 40 is positioned below the developer applying roller 14 that is provided at an upper part of the tank 11. Furthermore, the holding part 40 extends in the axial direction of the developer applying roller 14 covering the inner periphery of the tank 11, a lower part of the doctor blade 15, and a lower part of the developer applying roller 14.

In the holding part forming section 41, a gear pump 17 serving as a developer transfer member is provided to transfer the developing liquid 4 from the containing part 30 to the holding part 40. An inlet 17*a* of the gear pump 17 is open at the lowest position of the containing part 30. A net 18 serving as a foreign substance removing device is provided within the inlet 17*a* to remove foreign substances mixed with the developing liquid 4. Plural meshes can also be used as the foreign substance removing device. The foreign substance removing device can prevent a failure at the developer transfer member such as the gear pump 17 caused by foreign substances. Further, a thin developer layer of uniform thickness can be obtained more easily by removing foreign substances from the developing liquid 4.

Figure 3:
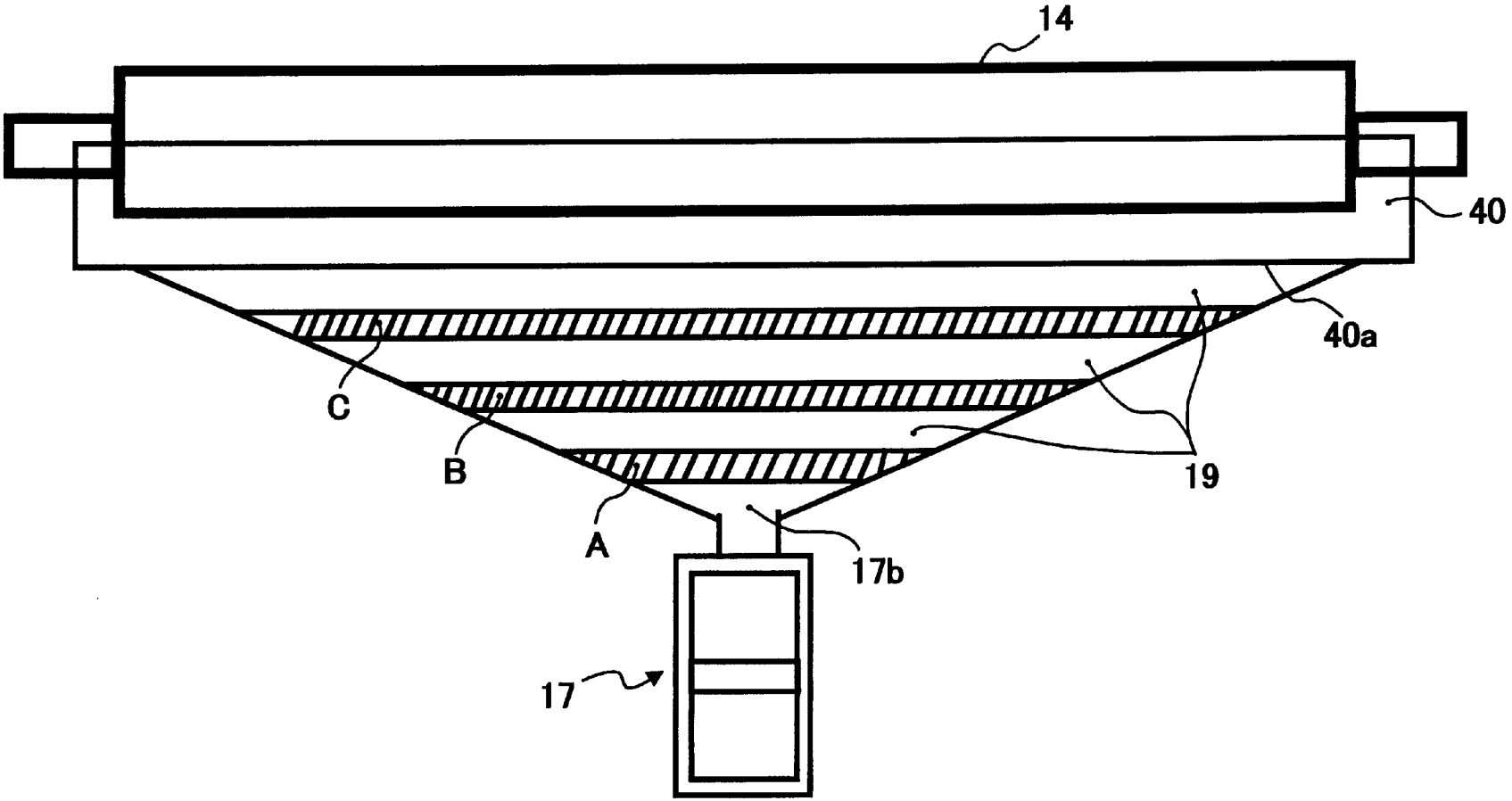
FIG. 3 is a schematic side view of the liquid-type developing device according to the first embodiment of the present invention.

Between an outlet 17*b* of the gear pump 17 and an inlet 40*a* of the holding part 40, a path 19 serving as a developer spread device is provided. The path 19 includes bend portions A, B, and C bending in the vertical direction as illustrated in FIG. 2. As illustrated in FIG. 3, the path 19 gradually extends from the outlet 17*b* of the gear pump 17 to the inlet 40*a* whose width is substantially the same as the length of the developer applying roller 14 in the axial direction.

In order to obtain a good quality image in the image forming apparatus according to this embodiment, the thin layer of the developing liquid 4 formed on the surface of the developing sleeve 12 is required to be formed to have uniform toner density and thickness. Generally, a roller having a smooth surface, which is also used in an ink applying process of a printer, is used as a developer applying device. As alternatives to a developer applying roller, a developer applying member of belt shape, sleeve shape, or the like, may be utilized. The developer applying roller has some merits because a thin developer layer of uniform thickness can be formed on the developer carrier and the developing mechanism is simple.

When the developing liquid 4 is applied to the developing sleeve 12 by the developer applying roller 14 having a smooth surface, and when the developing sleeve 12 and the developer applying roller 14 having a smooth surface rotate in the same direction at the nip part therebetween, the developing liquid 4 caught between the developing sleeve 12 and the developing applying roller 14 is likely to split into two layers when released. As a result, fine irregularities or voids (i.e., dot-like irregularities) or ribs (i.e., circumferential stripes) occur on the thin layer surfaces of the developing liquid 4 due to cavitation. The fine irregularities depend not only on the viscosity and surface tension of the developing liquid 4 but also on the liner velocity and contact pressure of the developing sleeve 12 and the developer applying roller 14. Therefore, it is difficult to form a fully flat surface of the layers of the developing liquid 4.

Generally, an amount of the developing liquid 4 applied to the surface of the developing sleeve 12 is controlled by the contact pressure and relative speed between the developer applying roller 14 and the developing sleeve 12. Therefore, when the developer applying roller 14 has a smooth surface, it is hard to accurately control the thin layer of the developing liquid 4 on the order of micrometers unless the deviation of the axis of the developer applying roller 14 and the pressure of the developer applying roller 14 are strictly controlled. Further, the developer applying roller 14 needs to be machined with high accuracy with respect to circularity, deviation between circumcenter and incenter, surface roughness, etc. As a result, sophisticated machining increases the device costs.

In order to solve the above-described problems and to form a uniform developing liquid layer on the developing sleeve 12, an anilox roller having a grooved surface can be employed as the developer applying roller 14 in this embodiment. Further, the doctor blade 15 is provided on the inner periphery of the tank 11 to face the developer applying roller 14. With the grooved surface of the anilox roller, the developer applying roller 14 holds a sufficient amount of the developing liquid 4. The doctor blade 15 abuts the developing applying roller 14 to remove excess developing liquid 4 applied on the developer applying roller 14. As a result, the amount of the developing liquid 4 on the developing applying roller 14 is accurately controlled.

Further, in this embodiment, the developer applying roller 14 is caused to move in the opposite direction to the developing sleeve 12 at the nip part therebetween so as to prevent the developing liquid 4 from splitting into two layers. As a result, the above-described fine irregularities, such as voids and ribs, can be avoided.

Furthermore, in this embodiment, the developer applying roller 14 can be caused to rotate at a higher linear velocity than the developing sleeve 12 so as to obtain uniform thickness of the developing liquid 4 without patterns made by the grooved surface of the developer applying roller 14.

With the above-described configuration, thin layers of the developing liquid 4 are formed with uniform thickness on the surface of the developing sleeve 12.

As illustrated in FIG. 2, the gear pump 17 includes two gears 17*c* and 17*d* engaged with each other. The gears 17*c* and 17*d* are driven by an electric motor (not shown). As alternatives to the gear pump 17, a piston-type pump, a vane pump, a moineau pump, a tube pump, a screw, or the like, may be employed as a developer transfer member.

The developing sleeve 12 is formed of a hollow cylindrical elastic member and is provided in contact with the developer applying roller 14 and the photoconductive drum 1. The driving roller 13 causes the developing sleeve 12 to rotate at the same peripheral speed and in the same direction as the photoconductive drum 1. The collecting blade 16 is provided above the containing part 30 in the tank 11 and contacts the surface of the developing sleeve 12. The driving roller 13 contacts a portion of the inner periphery of the developing sleeve 12 facing the collecting blade 16. That is, the driving roller 13 and collecting blade 16 sandwich the portion of the developing sleeve 12. At the portion where the driving roller 13 and collecting blade 16 sandwich the developing sleeve 12, a frictional force acts between the driving roller 13 and the developing sleeve 12 and allows the developing sleeve 12 to rotate.

As alternatives to the developing sleeve 12, a developing roller whose surface is coated with an elastic member, such as a rubber and/or having a soft member such as a sponge therein, a developing belt including an endless belt, or the like, may be employed as developer carriers.

The configuration of the developing device 10 will be described more specifically hereinafter together with the operation of the developing device 10.

In the above configured developing device 10, the developing liquid 4 contained in the tank 11 passes through the net 18 provided within the inlet 17*a* of the gear pump 17 by a suction force produced by driving the gear pump 17. After passing through the net 18, the developing liquid 4 is taken into a space formed between the gears 17*c* and 17*d* of the gear pump 17 and the inner periphery of the holding part forming section 41 and is transferred to the outlet 17*b* of the gear pump 17 by the rotations of the gears 17*c* and 17*d*. Once the developer liquid 4 is taken into the space formed between the gears 17*c* and 17*d* of the gear pump 17 and the inner periphery of the holding part forming section 41, it is configured that the developing liquid 4 does not return to the inlet 17*a*. Further, the developing liquid 4 is pumped upward from the outlet 17*b* and through the path 19 that connects to the inlet 40*a* of the holding part 40.

The developing liquid 4 flowing in the path 19 is further transferred toward the holding part 40 with the flow rate of the developing liquid 4 increased by the gear pump 17. As shown in FIG. 3, because the developing liquid 4 has high viscosity and the outlet 17*b* of the gear pump 17 is located at the center part of the path 19 that gradually extends from the outlet 17*b* to the inlet 40*a* in the axial direction of the developer applying roller 14, it may be hard to spread out the developing liquid 4 in the path 19 in the axial direction of the developer applying roller 14. Therefore, plural bend portions A, B, and C are provided in the path 19 to spread out the developing liquid 4 in the horizontal direction in this embodiment.

When the developing liquid 4 pumped upward from the outlet 17*b* flows to the first bend portion A, the developing liquid 4 strikes against a wall of the path 19 in the direction of its flow. The wall of the path 19 causes the developing liquid 4 to suddenly change its flow direction, and as a result the developing liquid 4 spreads out not only in the vertical direction but also in the horizontal direction (i.e., the width direction of the path 19) at the bend portion A. Likewise, the developing liquid 4 spreads out in the horizontal direction at the bend portions B and C provided in the path 19 through the holding part 40. As a result, the developing liquid 4 sufficiently spreads out in the horizontal direction until the developing liquid 4 flows to the holding part 40.

After flowing through the path 19, the developing liquid 4 flows into the holding part 40 from the inlet 40*a*. In the holding part 40, the developing liquid 4 is held such that a part of the developer applying roller 14 is soaked into the developing liquid 4. The excess developing liquid 4 runs out of the holding part 40 and drops into the containing part 30 and is again taken in the gear pump 17 for development.

The developing liquid 4, which is pumped upward by the gear pump 17 and is supplied to the developer applying roller 14, is regulated to a predetermined thickness by the doctor blade 15, and is then applied to the surface of the developing sleeve 12. The developing liquid 4 forming a thin layer on the surface of the developing sleeve 12 is transferred to a latent image formed on the photoconductive drum 1 at a developing station where the developing sleeve 12 and the photoconductive drum 1 face each other, and thereby a toner image corresponding to the latent image is formed on the photoconductive drum 1. After the developments at the developing station, the collecting blade 16 scrapes off the residual developing liquid 4 on the surface of the developing sleeve 12. The developing liquid 4 removed by the collecting blade 16 drops into the containing part 30 and is again used for development.

Figure 4A:
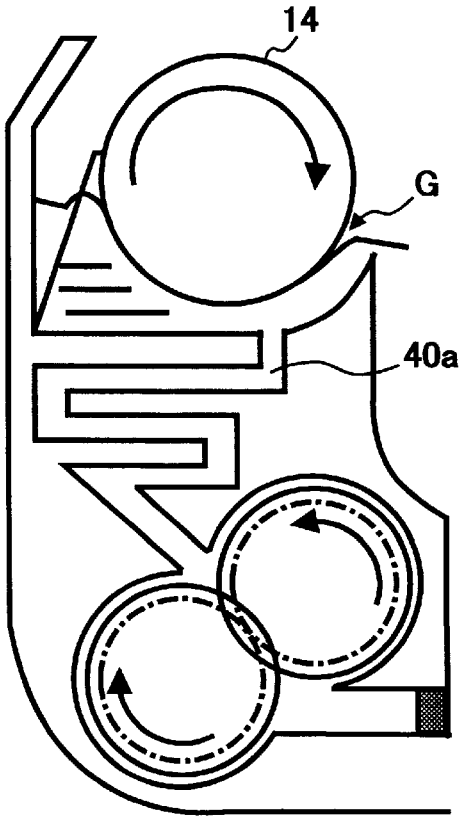
FIGS. 4A and 4B are partial enlarged views of the liquid-type developing devices according to the first embodiment of the present invention.
Figure 4B:
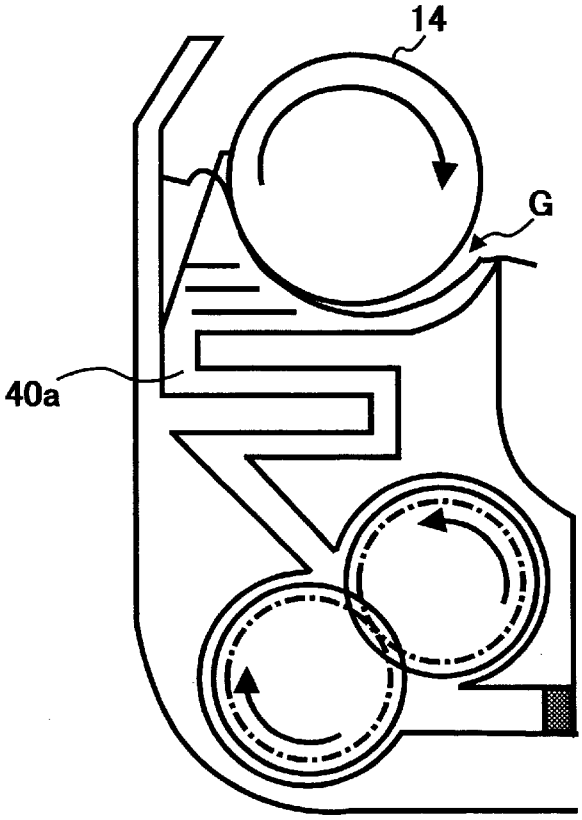

In the holding part 40, the developer applying roller 14 transfers the developing liquid 4 while rotating. However, because the developing liquid 4 has high viscosity, the aforementioned hanging back phenomenon occurs when the developer applying roller 14 rotates. In order to avoid the hanging back phenomenon, the inlet 40*a* of the holding part 40 is positioned upstream from the most deeply soaked bottom part of the developer applying roller 14 in the rotating direction of the developer applying roller 14 as illustrated in FIG. 4A in this embodiment. If the inlet 40*a* is positioned downstream from the most deeply soaked bottom part of the developer applying roller 14 in the rotating direction of the developer applying roller 14 as illustrated in FIG. 4B, the hanging back phenomenon occurs. In contrast, in the case of FIG. 4A, when the developing liquid 4 whose flow rate is increased by the gear pump 17 flows into the holding part 40 from the inlet 40*a*, the surface of the developing liquid 4 around the inlet 40*a* is increased. As a result, in the case of FIG. 4A the gap G formed between the surface of the developing liquid 4 and the surface of the developer applying roller 14 under the influence of the hanging back phenomenon is filled by the raised developing liquid 4. However in the case of FIG. 4B, the gap G is not easily filled because the developing liquid 4 flows into the place of the holding part 40 apart from the gap G. Thereby, by utilizing the structure as shown in FIG. 4A the hanging back phenomenon is effectively prevented in this embodiment, so that the developing liquid 4 can be uniformly supplied to the developer applying roller 14.

As described earlier, the developing liquid 4 includes an insulative carrier liquid in which toner particles are dispersed. Therefore, when the developing liquid 4 is left unused in the containing part 30 of the tank 11 for a long period of time, the toner may precipitate and the toner density may become irregular in the vertical direction in the containing part 30. The configuration of the developing device 10 of this embodiment allows the developing liquid 4 to be agitated to a certain degree by its circulation system. However, when the developing liquid 4 is used after being left unused for a long period of time, it is necessary to circulate the developing liquid 4 for a while to be agitated enough for development.

Figure 5:
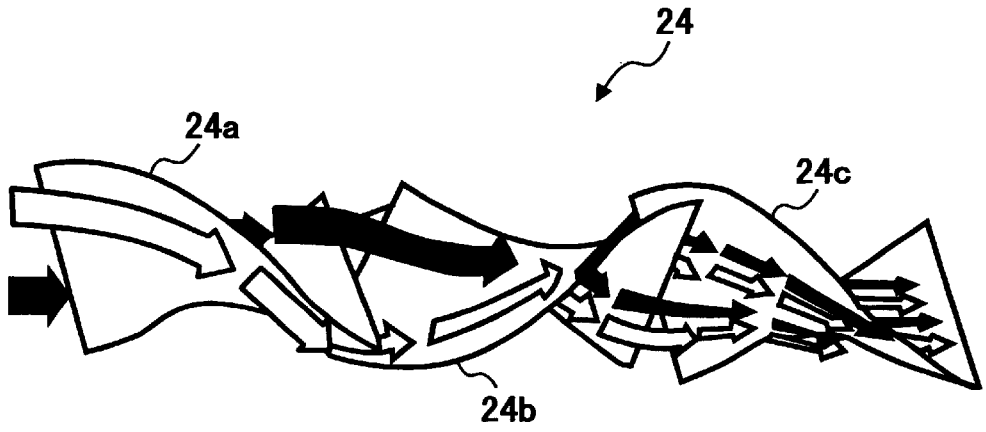
FIG. 5 is an explanatory view of a static mixer of the liquid-type developing device according to the first embodiment of the present invention.

Therefore, as shown in FIG. 5, a static mixer 24 serving as a developer agitating device is provided at the outlet 17*b* of the gear pump 17. FIG. 5 illustrates the static mixer 24. The static mixer 24 is provided between the outlet 17*b* of the gear pump 17 and the first bend portion A in FIG. 2. The static mixer 24 includes a plurality of fins in a shape of twisted plates that are aligned in the transfer direction of the developing liquid 4 with their placement angles displaced relative to each other. In this embodiment, the number of fins is set to three, as an example. With the above-described configuration, as illustrated in FIG. 5, the developing liquid 4 discharged from the outlet 17*b* is divided into two flows (represented by the hollow white arrows and the filled-in black arrows) by a first fin 24*a* and then transfers along the twisted surface of the first fin 24*a*. Next, a second fin 24*b* divides the developing liquid 4 into two further flows and each half of the two further flows divided by the first fin 24*a* gets confluent and mixed with each other. Likewise, a third fin 24*c* repeats to divide the developing liquid 4 and mix divided flows. As a result, after flowing through the static mixer 24, the developing liquid 4 sufficiently gets agitated. As alternatives to the developer agitating device, a propeller, a rotor, or the like, can be employed. However, the developer agitating device of passing through type, such as the static mixer, is advantageous in simplification of mechanism and miniaturization of device.

With the above-described developer agitating device such as the static mixer 24 provided at the outlet 17*b* of the gear pump 17, the developing liquid 4 can be agitated immediately through the use of the flow of the developing liquid 4 even when the developing liquid 4 is used after being left unused for a long period of time. Therefore, the image forming apparatus can form high quality images such as uniform images. In this embodiment, the developing liquid 4 can be agitated effectively through the use of the flow of the developing liquid 4 by the developer agitating device, which is more effective than placing a developer agitating device at a position at which the developing liquid 4 does not flow.

Figure 6:
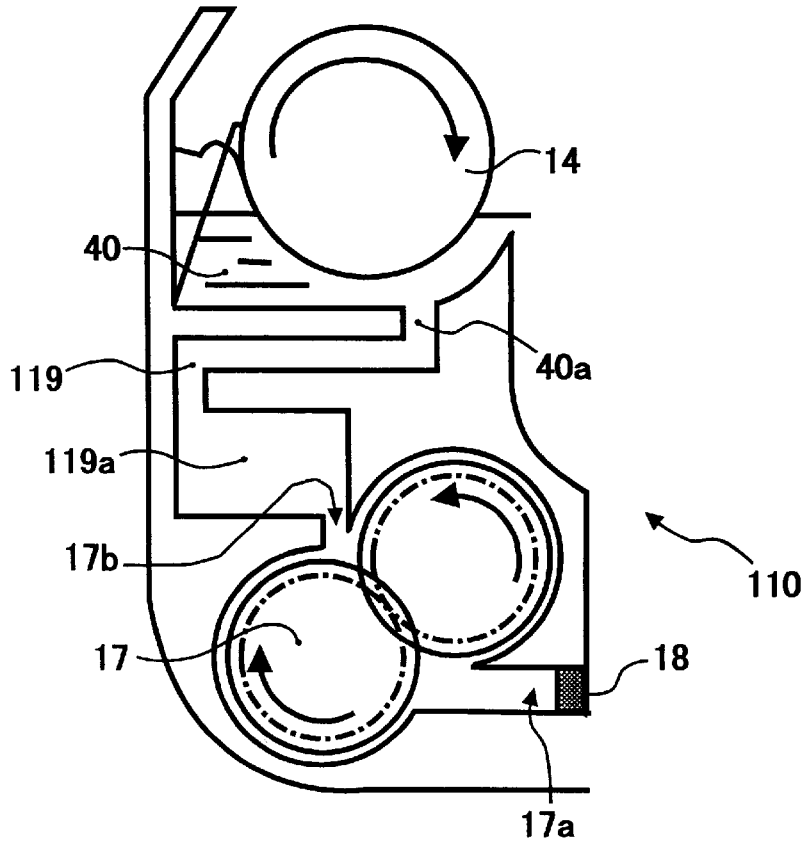
FIG. 6 is a partial enlarged schematic view of a liquid-type developing device according to a second embodiment of the present invention.

Next, a second embodiment of the present invention is explained. FIG. 6 is an enlarged view illustrating a schematic configuration around the holding part 40 of a developing device 110 according to the second embodiment of the present invention. The configuration of the developing device 110 is similar to the developing device 10 of the first embodiment except for the developer spread device. The image forming operation of the image forming apparatus in the second embodiment is substantially the same as the one in the first embodiment, and thereby the detailed description for the configuration and operation of the image forming apparatus of the second embodiment is omitted to avoid redundancy.

In the second embodiment, a path 119 including a partitioned part 119*a* is provided as a developer spread device between the outlet 17*b* of the gear pump 17 and the inlet 40*a*. Specifically, the path 119 extends gradually between the width of the outlet 17*b* of the gear pump 17 in the horizontal direction and the width of the inlet 40*a* in the horizontal direction that has substantially the same length as the developer applying roller 14 in the axial direction. In addition, the cross-sectional area of the partitioned section 119*a* is different from the cross-sectional area of other parts in the path 119.

The developing liquid 4 flowing in the path 119 moves toward the holding part 40 with its flow rate increased by the gear pump 17. First, the developing liquid 4 discharged from the outlet 17*b* of the gear pump 17 flows into the partitioned section 119*a* that has a greater cross-sectional area. When the developing liquid 4 flows out of the partitioned section 119*a*, the developing liquid 4 further flows into the part of the path 119 that has a smaller cross-sectional area. Particularly, the developing liquid 4 is caused to strike against a wall of the path 119 in the direction of its flow, and to move along the wall of the path 119 and flow into the part of the path 119 that has a smaller cross-sectional area. While moving in the path 119 as described above, the developing liquid 4 spreads out not only in the vertical direction but also in the horizontal direction (i.e., the width direction of the path 119). Therefore, the developing liquid 4 is transferred to the holding part 40 in a condition that the developing liquid 4 sufficiently expands in the horizontal direction.

If plural bend portions are provided in the path 119 as in the first embodiment, the developing liquid 4 can expand in the horizontal direction more efficiently.

Figure 7:
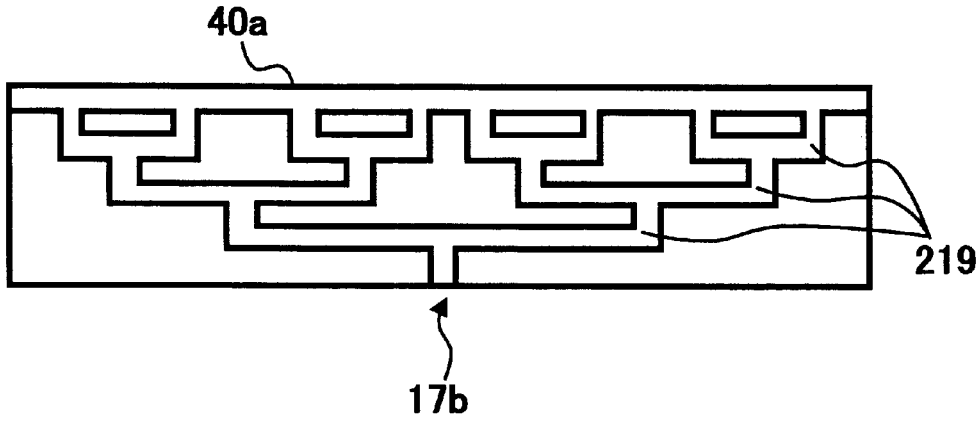
FIG. 7 is a schematic view of a modification of a developer spread device of the liquid-type developing device of the present invention.
Figure 8:
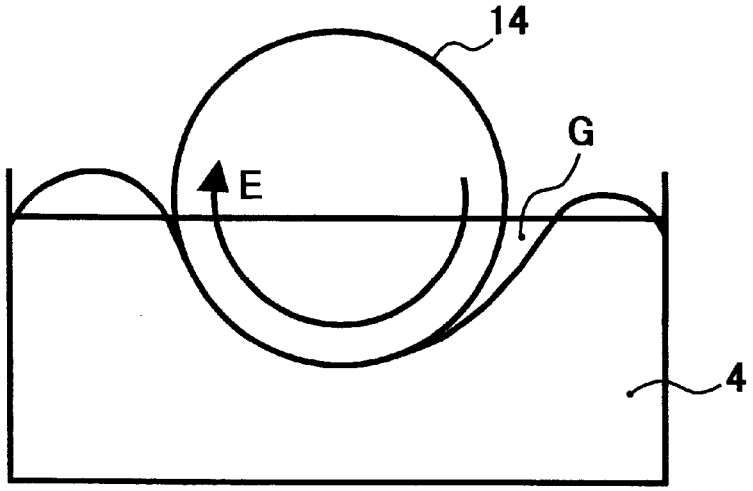
FIG. 8 BACKGROUND ART
FIG. 8 is an explanatory view of a hanging back phenomenon.

FIG. 7 illustrates a modification of the above-described developer spread device (i.e., the paths 19 and 119) of the first and second embodiments. In that modification a path 219 may include plural branch points that branch off in the horizontal direction between the outlet 17*b* of the gear pump 17 and the outlet 40*a* of the holding part 40, and plural vents arranged in the horizontal direction that connect to the outlet 40*a* of the holding part 40.

In the above-described embodiments, owing to the configuration of the developer transfer device including the gear pump 17, the paths 19, 119, 219, and the holding part 40, a sufficient amount of the developing liquid 4 can be supplied to the developing applying roller 14 irrespective of the amount of the developing liquid 4 in the tank 11. Therefore, a shape or a size or volume of the tank 11 can be set without limitation.

Further, with the above-described configuration of the developing device, the developing liquid 4 can be uniformly applied to the developing sleeve 12 and thin developer layer of uniform thickness can be formed on the surface thereof. Therefore, good quality images can be obtained in the image forming apparatus of the present invention.

Obviously, numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 10-335558 filed in the Japanese Patent Office on Nov. 26, 1998, and the entire contents of which are hereby incorporated herein by reference.

What is claimed as new and is desired to be secured by Letters Patent of the United States is:

1. An image forming apparatus to develop a latent image formed on an image bearing member with a liquid type developer, comprising:

a developer container configured to contain the liquid type developer;

a developer carrier configured to carry the liquid type developer to supply the liquid type developer to the image bearing member;

a developer applying device configured to apply the liquid type developer to the developer carrier;

a holding part configured to hold a part of the liquid type developer contained in the developer container, said holding part being located below the developer applying device so that the developer applying device contacts the part of the liquid type developer held in the holding part and said developer applying device has a coating of the liquid type developer thereon;

a developer transfer device configured to transfer the liquid type developer from the developer container to the holding part.

2. An image forming apparatus to develop a latent image formed on an image bearing member with a liquid type developer, comprising:

a developer container configured to contain the liquid type developer;

developer carrier configured to carry the liquid type developer to supply the liquid type developer to the image bearing member;

a developer applying device configured to apply the liquid type developer to the developer carrier;

a holding part configured to hold a part of the liquid type developer contained in the developer container, said holding part being located below the developer applying device; and a developer transfer device configured to transfer the liquid type developer from the developer container to the holding part, wherein the liquid type developer has a viscosity in the range of 100 mPa·s to 10,000 mPa·s.

3. An image forming apparatus according to claim 2, wherein the developer applying device includes a developer applying roller.

4. An image forming apparatus according to claim 3, wherein the developer applying roller is an anilox roller.

5. An image forming apparatus according to claim 3, wherein an inlet of the holding part for the liquid type developer is positioned upstream from a bottom part of the developer applying roller in the rotating direction of the developer applying roller.

6. An image forming apparatus according to claim 4, wherein an inlet of the holding part for the liquid type developer is positioned upstream from a bottom part of the developer applying roller in the rotating direction of the developer applying roller.

7. An image forming apparatus according to claim 3, wherein the developer transfer device includes, a developer transfer member whose width is smaller than a length of the developer applying roller in an axial direction, and a developer spread device provided between an outlet of the developer transfer member and an inlet of the holding part and configured to spread the liquid type developer in the axial direction of the developer applying roller.

8. An image forming apparatus according to claim 7, wherein the developer spread device includes a plurality of bend portions.

9. An image forming apparatus according to claim 7, wherein the developer spread device includes a partitioned part and another part having a smaller cross-sectional area than the partitioned part.

10. An image forming apparatus according to claim 7, further comprising a developer agitating device provided at an outlet of the developer transfer member and configured to agitate the liquid type developer.

11. An image forming apparatus according to claim 7, further comprising a foreign substance removing device provided at an inlet of the developer transfer member.

12. An image forming apparatus according to claim 8, further comprising a foreign substance removing device provided at an inlet of the developer transfer member.

13. An image forming apparatus to develop a latent image formed on an image bearing member with a liquid type developer, comprising:

developer container means for containing the liquid type developer;

developer carrier means for carrying the liquid type developer to supply the liquid type developer to the image bearing member;

developer applying means for applying the liquid type developer to the developer carrier means;

holding means for holding a part of the liquid type developer contained in the developer container means, said holding means being located below the developer applying means so that the developer applying means contacts the part of the liquid type developer held in the holding means and said developer applying means has a coating of the liquid type developer thereon; and developer transfer means for transferring the liquid type developer from the developer container means to the holding means.

14. An image forming apparatus to develop a latent image formed on an image bearing member with a liquid type developer comprising:

developer container means for containing the liquid type developer;

developer carrier means for carrying the liquid type developer to supply the liquid type developer to the image bearing member;

developer applying means for applying the liquid type developer to the developer carrier means;

holding means for holding a part of the liquid type developer contained in the developer container means, said holding means being located below the developer applying means; and developer transfer means for transferring the liquid type developer from the developer container means to the holding means, wherein the liquid type developer has a viscosity in the range of 100 mPa·s to 10,000 mPa·s.

15. An image forming apparatus according to claim 14, wherein the developer applying means includes a developer applying roller.

16. An image forming apparatus according to claim 14, wherein the holding means includes inlet means for inputting the liquid type developer.

17. An image forming apparatus according to claim 16, wherein the developer transfer means includes, developer input means whose width is smaller than a length of the developer applying means in an axial direction, and developer spread means provided between an outlet of the developer input means and the inlet means of the holding means for spreading the liquid type developer in the axial direction of the developer applying means.

18. An image forming apparatus according to claim 13, further comprising foreign substance removing means for removing a foreign substance from the liquid type developer.

19. An image forming apparatus according to claim 16, further comprising foreign substance removing means for removing a foreign substance from the liquid type developer.

20. An image forming apparatus according to claim 19, wherein the developer transfer means includes, developer input means whose width is smaller than a length of the developer applying means in an axial direction, and developer spread means provided between an outlet of the developer input means and the inlet means of the holding means for spreading the liquid type developer in the axial direction of the developer applying means.

* * * * *